United States Patent [19]

Shaw

[11] 4,229,835

[45] Oct. 28, 1980

[54] PADDED UNDERGARMENT FOR PHYSICAL FITNESS

[76] Inventor: Joy D. Shaw, 3444 Spring Bluffs Pl., Lauderhill, Fla. 33319

[21] Appl. No.: 961,664

[22] Filed: Nov. 17, 1978

[51] Int. Cl.[2] ..... A41B 9/00

[52] U.S. Cl. ..... 2/406; 128/288; 2/221; 2/237

[58] Field of Search ..... 2/406, 403, 402, 400, 2/227, 231, 79, 237, 221; 128/288

[56] References Cited

U.S. PATENT DOCUMENTS

| | | | |
|---|---|---|---|
| 1,383,491 | 7/1921 | Secrest | 2/79 |
| 2,250,506 | 7/1941 | Snyder | 2/406 |
| 2,401,457 | 6/1946 | Bryant | 2/406 |
| 3,307,203 | 3/1967 | Parsont et al. | 2/231 |

FOREIGN PATENT DOCUMENTS

| | | | |
|---|---|---|---|
| 673363 | 4/1966 | Belgium | 2/406 |
| 1294232 | 4/1962 | France | 2/406 |
| 1144674 | 3/1969 | United Kingdom | 2/406 |

*Primary Examiner*—H. Hampton Hunter

*Attorney, Agent, or Firm*—Barry L. Haley; Eugene F. Malin; Philip R. Wadsworth

[57] ABSTRACT

An undergarment for athletic activities such as bicycling, horseback riding, jogging, or the like which provides a thin padded area for protecting the crotch from discomfort, uplift support for the buttocks, and firming of the skin of the lower torso area. The undergarment is comprised of a flexible, stretchable fabric wall that conforms to the lower torso of a human being having elastic waist and leg bands joined together at the waist by adjustable fasteners, a thin ventilated, resilient pad disposed in the crotch area, and a "Y"-shaped support band extending in the rear panel of the garment from the back waistband vertically to the resilient pad. The stretchable material firms the skin in the area covered. The thin pad protects the crotch area from discomfort when sitting, without encumbering movement. The "Y"-shaped support band provides uplift support to the buttocks. The undergarment is shaped to fit snugly against the body regardless of the body motion while remaining unobservable when worn with an outer garment.

1 Claim, 7 Drawing Figures

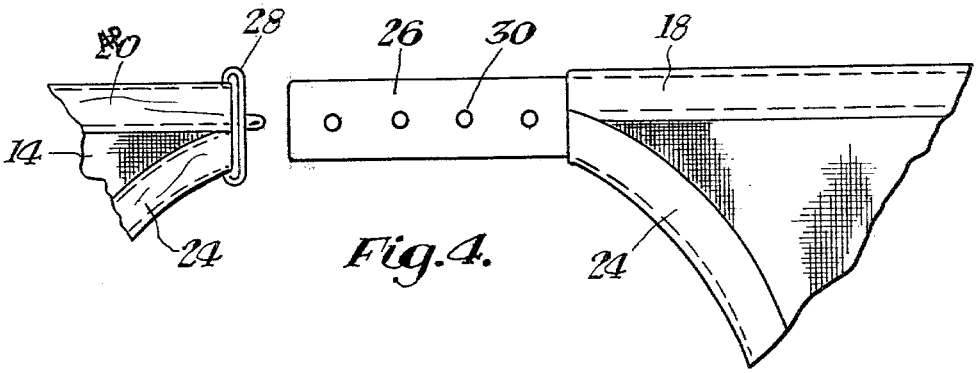
Fig.4.
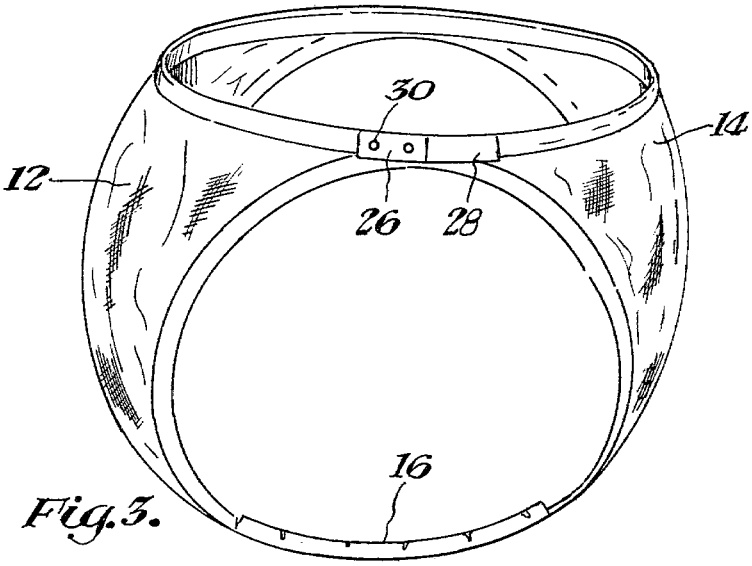
Fig.3.
Fig.5a.
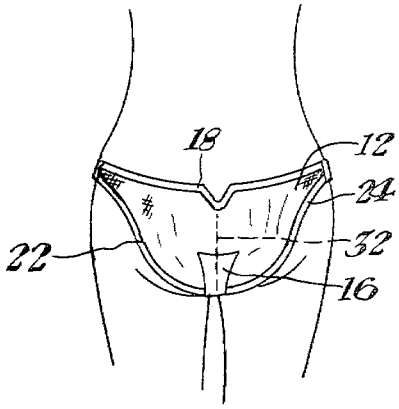
Fig.5b.
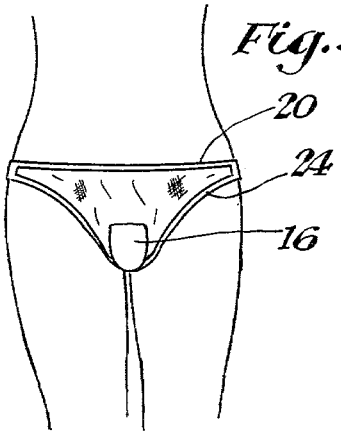
Fig.5c.
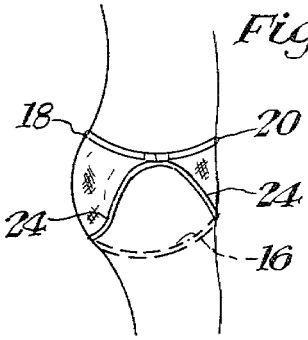

PADDED UNDERGARMENT FOR PHYSICAL FITNESS

BACKGROUND OF THE INVENTION

This invention relates generally to a protective, supportive undergarment to be worn by a person for engaging in a variety of athletic activities to protect the crotch of the body from soreness or discomfort which may be experienced from long or constant sitting and straddling of a bicycle seat, saddle or the like, to uplift the buttocks at all times, and to firm the body skin of the lower torso area. The undergarment is especially suited for activities such as bicycling, jogging, horseback riding and exercises performed on conventional exercising devices.

In recent years, many people have begun to engage in all forms of physical fitness which are often done in public areas. Present day garments and undergarments have been found to be unsightly to wear in a public environment or are often times cumbersome for a person engaged in physical activity. Also, various forms of present exercising which include bicycling, horseback riding, and the use of conventional exercising devices require the exerciser to remain seated for periods of time. Bicycle seats have traditionally had a unique but uncomfortable shape (also found on some exercising devices) which is necessitated by allowing leg motion to achieve exercise. These types of seats do no provide normal support of the human buttocks found in conventional chairs which have a broader platform for allowing pressure distribution for greater comfort. Many present day garments have been deficient in that when utilizing the garments, they often ride up the buttocks or crotch area becoming unsightly when used in public. Also, many present day garments are quite baggy and do not provide any support for the wearer and generally look unattractive.

The present invention described herein overcomes deficiencies of garments previously used in that it provides for protection from soreness or discomfort in the crotch area, provides support and uplift of the buttocks area, firming of the skin areas of the lower torso, while preventing the garment from riding up in areas that would be unattractive.

BRIEF DESCRIPTION OF THE INVENTION

An undergarment useable for engaging in physical fitness activities having a lightweight, stretch fabric wall which includes a waist opening formed by a pair of front and back elastic waist bands in conjunction with elasticized leg openings all of which are joined at the waist area on each side by adjustable fasteners. The fabric wall includes thin aerated resilient pads disposed from the front mid portion of the crotch to the buttock area. The elastic leg openings bands are connected to the sides of the thin pad. The padding may consist of a sponge-like thin layer of aerated polester eurathane material or a resilient natural padding such as chamois, either of which is washable, and covered with cotton fabric.

The padded portion is relatively thin to allow for complete and uninhibited leg movement of the wearer but is sufficiently thick to provide resilient padding to the crotch area to prevent discomfort when sitting or riding.

The fabric wall is lightweight and preferably made of a synthetic fabric known under the trademark LY- CRASPANDEX which is also washable. The fabric stretches resiliently such that it readily conforms to the body contour while providing support to provide a smooth overall appearance preventing bulges or the like. Thus, when worn with an outer garment, the undergarment herein described does not produce visible ridges or bulges.

The padding itself may be also comprised of a synthetic molded material that could be contoured to accommodate the physiology of the crotch area both for male and female wearers. The preferred embodiment shown herein is designed for a female undergarment.

The front and back elastic waistbands, in conjunction with the elasticized leg opening bands cooperate with the fabric wall in the rear area in conjunction with a Y-shaped elasticized support band that runs vertically up the midportion of the rear fabric wall engaging at its top and the back waistband while connected at the lower ends to the pad itself. This structural cooperation produces an uplift support on the buttocks, and at the same time prevents the garment from riding up the buttocks on either side regardless of the motion or stretching of the wearer. The Y-shaped structural element provides for individualized support of each buttock so that motion or stretching will not affect the garment while being worn.

It is an object of this invention to provide a lightweight washable undergarment that provides additional support for the buttocks, does not ride up the torso area during motion, provides for a firming of the skin area of the torso while maintaining a smooth contour of the body.

It is another object of this invention to provide a lightweight washable undergarment that includes performed pads to reduce discomfort experienced by an athlete from sitting on an athletic device, while not encumbering motion of the athlete.

It is another object of this invention to provide a lightweight undergarment that acts as a resilient protective shield for the lower torso of the person when seated and which is not readily seen nor detectible through the outer garment.

And yet, still another object of this invention is to provide a resilient, protective garment that is lightweight and has specific contour padded portions to accommodate different physiology between male and female to protect the crotch of a bicyclist from discomfort, to provide support for the buttocks, and to prevent the garment sides from riding up the buttock or crotch area.

In accordance with these and other objects which will be apparent hereinafter, the instant invention will now be described with particular reference to the accompanying drawings.

BRIEF DESCRIPTION OF THE DRAWINGS

FIG. 3 shows a side elevational view of the garment as it would appear when being worn.

FIG. 4 is a fragmentary view showing the waist fastener and fragmentary portions of the instant invention from a side elevational view.

FIG. 5*a* shows a back elevational view of the garment as worn by a person.

FIG. 5*b* shows a front elevational view of the instant invention as being worn.

FIG. 5*c* shows a side elevational view of the garment on a person.

PREFERRED EMBODIMENT OF THE INVENTION

Figure 1:
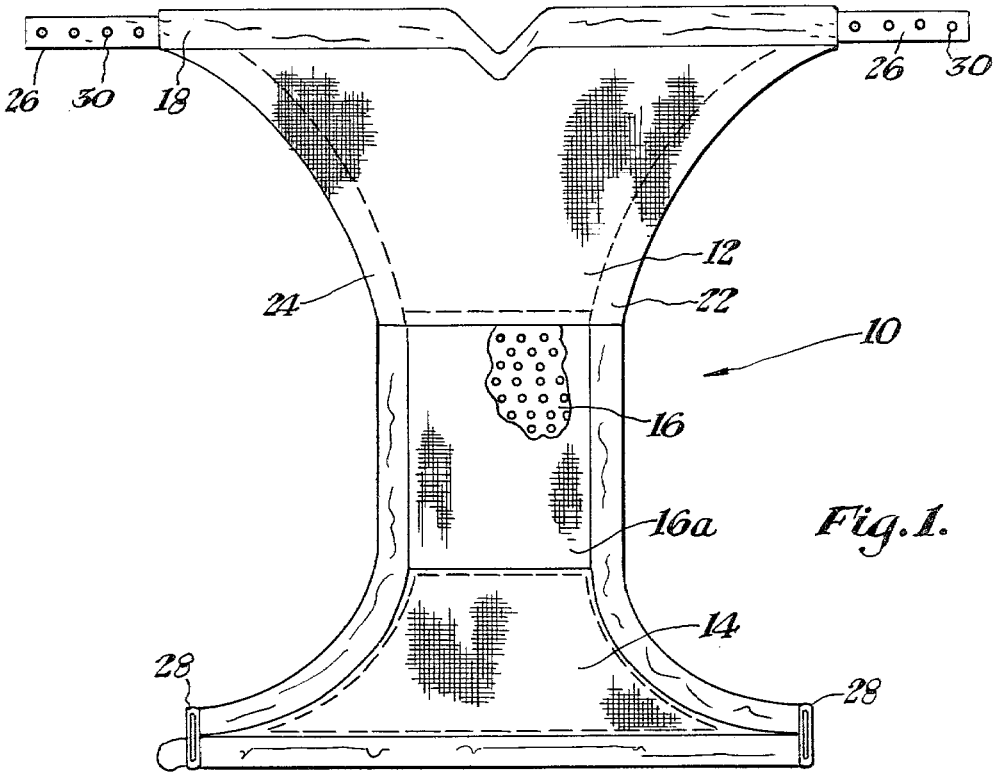
FIG. 1 shows the instant invention viewed from the outside in a bottom plan view.
Figure 2:
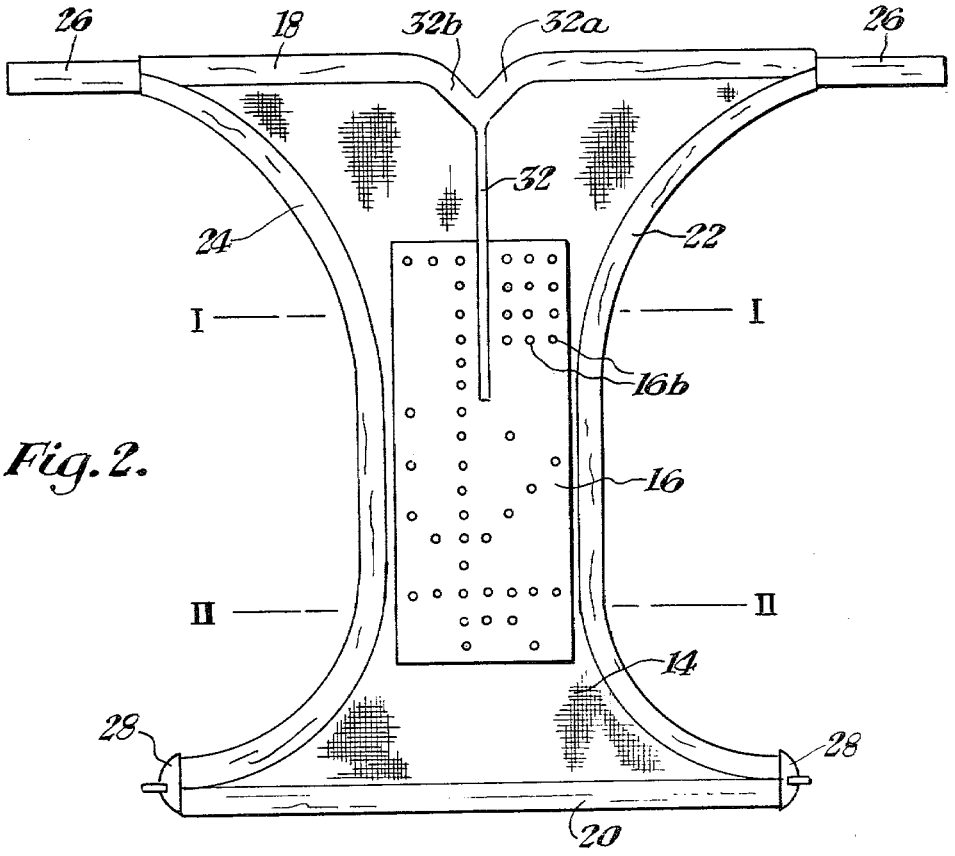
FIG. 2 shows the inside of the instant invention as viewed in a top plan view.

Referring now to the drawings and specifically FIGS. 1 and 2, the instant invention is shown generally at 10 comprised of a first piece of light weight fabric 12 shaped somewhat like a truncated triangle which forms the rear wall of the garment. Affixed to the upper top portion of rear fabric wall 12 is an elastic band 18 that is joined at each end to a pair of fasteners 26 having apertures 30 for receiving a hook or the like. The side walls of the back fabric wall 12 include leg elastic straps 22 and 24 which are disposed from the rear panel 12 to a front fabric panel 14 on each side. Leg encircling elastic bands 22 and 24 terminate in hook fasteners 28 and are connected thereto and to a front elastic waistband 20. The mid portion of the garment includes a thin resilient pad 16 which proceeds from the portion of the rear fabric wall to the front fabric wall 14 such that pad 16 (when in use) would encompass an area from the upper front crotch back to the buttocks of the person. A fabric panel 16*a* may be constructed unitarily with the front panel 14, forming a single piece of fabric that extends from the back fabric wall 12 through the crotch area 16*a*, through the front portion of the garment.

FIG. 2 shows the inside of the garment including the pad 16 which has a plurality of apertures 16*b* which aid in aeration and resiliency of the pad. Lines I and II delineate an area which represents the limits of the crotch area of the wearer showing that the pad 16 overlaps beyond the crotch area to the rear buttock portion and front torso portions above the crotch. Thus, the elongated pad 16 insures that the torso area beyond and overlapping the crotch area are protected by the padding to accommodate particular sitting positions by the wearer. A "Y"-shaped reinforced elastic support band 32 is connected from the back waist band of the upper middle portion of the back fabric wall terminating in the pad for added strength of the garment and support of the buttocks. The front fabric wall 14 includes a pair of hooks 28 which are joined to the elastic waistband 20 and the leg encompassing elastic bands 22 and 24. The hooks 28 used in conjunction with the fastener apertures on fastener 26 allow for adjustable fitting of the garment for various sized individuals.

FIG. 3 shows how the fastener 26 may be engaged to hook 28 in any one of a series of apertures 30. FIG. 3 also shows a pad 16 disposed from the rear of the garment through the forward portion of the crotch area.

FIG. 4 shows the fastener 26 and how it cooperates with hook 28 which may be received in any one of apertures 30 to achieve the proper size. FIG. 4 also shows the structural connection of the front waistband 20 and the rear waistband 18 and its cooperation with the leg engaging elastic band 24 that provides elasticized support around the leg and buttock areas in conjunction with the holding force around the waist of the individual. The cooperation with support band 32 insures supportive uplift of the buttocks and firm support of the skin in the lower torso area.

FIG. 5*a* shows the garment supported from the back to provide support to the buttocks with the pad overlapping the buttocks area and restrained by leg encompassing straps 22 and 24. The elasticized force generated from elastic band 22, 24, and 32 act to support back panel 12 and the buttocks in conjunction with the force provided by elastic band 18.

FIG. 5*b* shows the same supporting effect on the front of the wearer and the overlapping of pad 16 to the front upper crotch area for added protection.

FIG. 5*c* shows the garment from the side including the leg encompassing elastic band 24 in conjunction with the waist bands 18 and 20 which firmly support the garment on the wearer.

The fabric wall is selected to be a light weight washable fabric and may be made of synthetic or natural fibers. The pad, which may be preformed may be constructed of a polyester eurathane thin sheet of material or other suitable padding that allows for washing. The garment when used, will not ride up the buttocks area of the wearer regardless of the type of movement experienced by the wearer. Further, the padding and material is sufficiently thin such that it is not readily visible through the outer garment. Construction of the invention also allows for freedom of movement of the athlete without emcumbering any particular motion and in fact is such a lightweight garment that the athlete need not notice its presence. The stretchable material in conjunction with the elastic bands causes the garment to fit "skin-tight" for firming and support.

The garment, although shown for a female athlete, may be modified to accommodate the physiology of a male by providing in the padding area a concave pouch-like padded area which may be preformed to accommodate the male physiology. Other than the alterations on the padded area itself, other portions of the invention such as the elastic straps and fasteners would remain essentially the same.

The pad is connected on its sides to the elastic leg opening bands to prevent unsightly bulges and riding up of the garment in the crotch area.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A lightweight undergarment for providing both padded protection in the crotch area of the wearer and lifting support of the buttocks, comprising:

a stretchable, flexible resilient panel consisting of a fabric or fabric like material, said panel having a longitudinal axis and a first end to be disposed in the front waist area of the wearer and a second end representing the rear waist area of the wearer, said panel having a lateral mid portion substantially narrower than the lateral ends, said lateral mid portion being sized to be received in the crotch area of the wearer;

first and second elastic bands being connected to the sides of said panel, said first and second elastic bands forming first and second leg-encompassing straps;

a third elastic band connected along the edge of the front panel end forming a front elastic waist band;

a fourth elastic band connected along the rear end portion of said panel, said rearly fastened elastic band including a centrally disposed Y-shaped elastic band, a portion of which is connected along the longitudinal axis from the rear waist band toward the central portion of said panel terminating in the crotch area of the panel;

a resilient pad disposed substantially in the crotch area of the wearer connected to said panel; and a plurality of fasteners connected at the ends of said first, second, third and fourth elastic bands for fastening the front waist band to the rear waist band, said resilient pad being disposed along the longitudinal axis of the panel and overlapping the crotch and buttocks area of the wearer.

* * * * *